US008132875B2

(12) United States Patent
Juang

(10) Patent No.: US 8,132,875 B2
(45) Date of Patent: Mar. 13, 2012

(54) THREE-SECTIONAL RAIL STRUCTURE

(76) Inventor: Jheng-Hong Juang, Taipei Hsien (TW)

( * ) Notice: Subject to any disclaimer, the term of this patent is extended or adjusted under 35 U.S.C. 154(b) by 804 days.

(21) Appl. No.: 12/193,053

(22) Filed: Aug. 18, 2008

(65) Prior Publication Data

US 2010/0040313 A1 Feb. 18, 2010

(51) Int. Cl.
*A47B 88/04* (2006.01)

(52) U.S. Cl. ..... 312/334.47; 312/333

(58) Field of Classification Search ..... 312/333, 312/334.1, 334.4, 334.7, 334.8, 334.16, 334.44, 312/334.46, 334.47
See application file for complete search history.

(56) References Cited

U.S. PATENT DOCUMENTS 3,059,986 A * 10/1962 Miller, Jr. ..... 312/334.8
3,133,768 A * 5/1964 Klakovich ..... 384/17
4,370,007 A * 1/1983 Fler ..... 312/334.11
6,805,418 B2 * 10/2004 Milligan ..... 312/333
2006/0066190 A1 * 3/2006 Hay ..... 312/333
2007/0018546 A1 * 1/2007 Bridges et al. ..... 312/330.1
2008/0197759 A1 * 8/2008 Chen et al. ..... 312/334.1
2009/0091225 A1 * 4/2009 Yang ..... 312/334.1

* cited by examiner

*Primary Examiner* — James O Hansen
*Assistant Examiner* — Matthew Ing

(57) ABSTRACT

A multiple steps rail arranged in the two opposite sides of a frame includes a retainer, a first sliding unit, and a second sliding unit in each side. The retainer is approximately a concave body and a plurality of stopping units are formed on proper positions thereof. The first sliding unit is approximately a bow body and can be sliding arranged into the retainer. The first sliding unit further has a dip switch and a double-side stopping unit on a side facing the retainer. The second sliding unit is sliding arranged into the first sliding unit and can be fixed to a case body with a side thereof. When the case body is drawing out, the second sliding unit will slide out from the first sliding unit and the first sliding unit will slide out from the retainer in order.

5 Claims, 10 Drawing Sheets

THREE-SECTIONAL RAIL STRUCTURE

FIELD OF THE PRESENT INVENTION

The present invention relates to a rail, and in particular to a rail arranged on a frame and provides multiple steps sliding movement.

DESCRIPTION OF THE PRIOR ART

A lot of designs of sliding guide and rail set are provided in the market nowadays. A prior art of simple drawable function as a normal drawer provided to users in the beginning is not adaptable to a larger machine casing in industry. Therefore, various designs with special functions are developed.

For example, in one prior art relates to a positioning structure of a sliding unit of a drawer rail. It includes a positioning unit, a sliding unit, and a releasing unit. The positioning unit is arranged on an opening end of a first rail and a spring hook is extending from thereof. The sliding unit is arranged between the first rail and a second rail, and a front end thereof is formed as a slot. The releasing unit is installed to the first rail.

When the second rail leaves the first rail, the spring hook of the positioning unit will temporarily buckle the slot of the sliding unit which is sliding with the second rail. While the second rail slides into the first rail again, an incline of the releasing unit will release the buckling of the spring hook and the slot. Thus, a sliding positioning function is performed in the invention.

Another early prior art relates to automatic restoring structure of multiple steps rail. It includes a sliding block and hook, and further includes an inner rail fixing unit operating with an outer rail and middle rail/or inner rail. The sliding block can be pulled back to an end portion of the outer rail by a first spring unit, while the hook including a double-hook is against the sliding block by a second spring unit. Thus, an automatic restoring function is achieved by the structure mentioned above.

In accordance with various machine casing rails, the inventor accomplished a rail design of the present invention which is more practical and different from the above patents.

SUMMARY OF THE PRESENT INVENTION

Accordingly, the primary object of the present invention is to provide a multiple steps rail structure, and by a dip switch and a double-side stopping unit formed on a first sliding unit to improve the convenience of usage.

The secondary object of the present invention is to restrain the sliding distance and range through the double-side stopping unit of the first sliding unit so as to prevent an object being departed from the rails by an improper force.

Another object of the present invention is to provide a simple structure, convenient installation, and time-saving design comparing with a prior art.

To achieve above object, the present invention provides a multiple steps rail structure parallel arranged between a frame and a case body comprising: a retainer; each longitudinal side thereof being bent as a rectangular slot which is an approximately concave body with a predetermined width between the slots and having a plurality of stopping units on a flat between the slots; a first sliding unit being arranged within the width between the slots of the retainer; each longitudinal side thereof having a groove and a dip switch and a double-side stopping unit being formed on a flat thereof facing the retainer; the dip switch being capable of moving a extending buckle; a second sliding unit having a flat, the flat having a guiding groove; a plurality of positioning grooves and a plurality of through holes for locking a case body; each longitudinal side of the second sliding unit having a guiding column for fitting into the grooves of the first sliding unit so that the second sliding unit will be slideably arranged into the first sliding unit; through moving the case body fixed on the second sliding unit, the second sliding unit and the first sliding unit sliding out from or being received by the first sliding unit and the retainer respectively in order; the extending buckle operating with the guiding groove of the second sliding unit so that the extending buckle will perform a positioning function on different positioning grooves of the second sliding unit.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
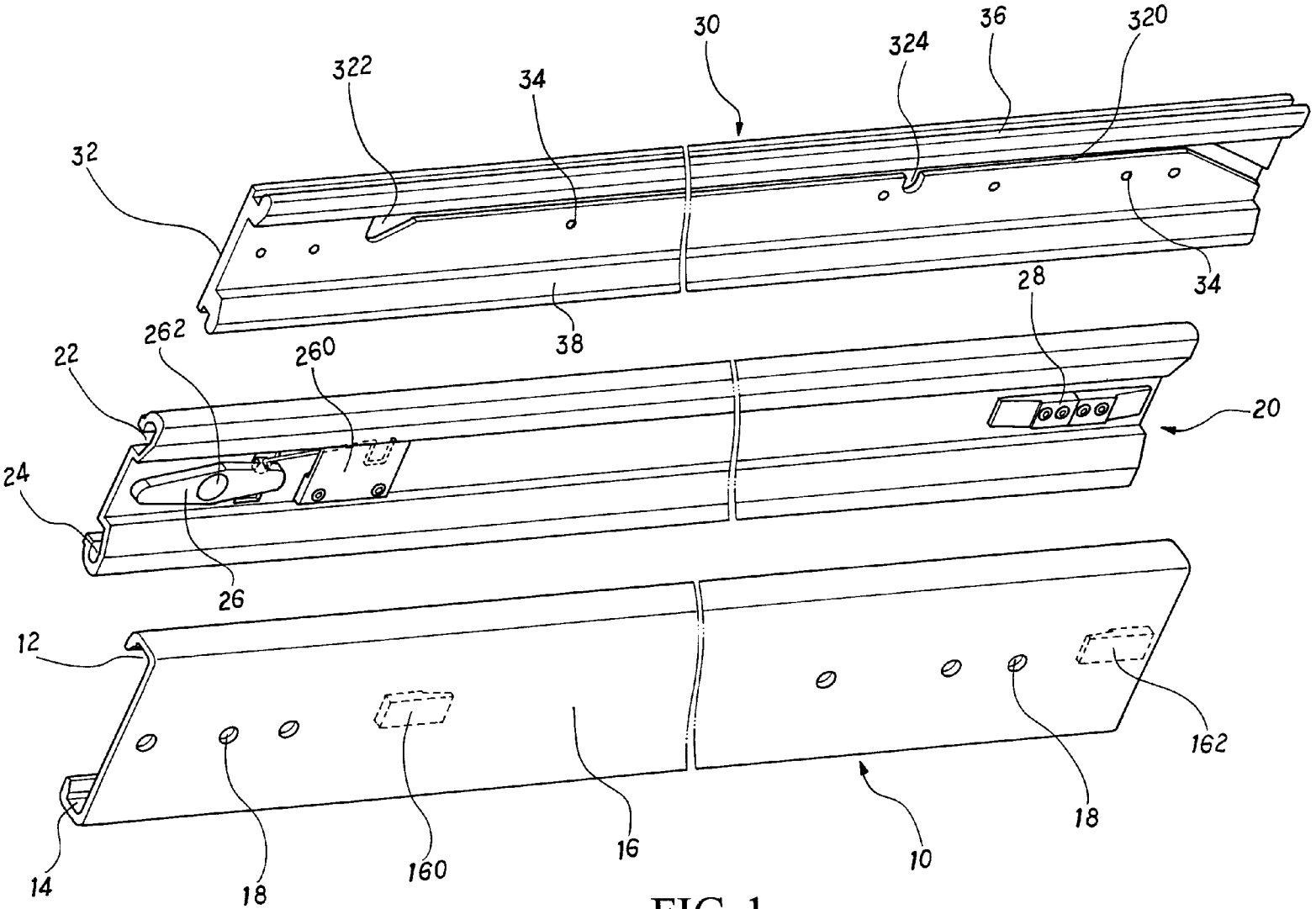
FIG. 1 is a prospective view showing the disassembly of the multiple steps rail of the present invention.
Figure 4:
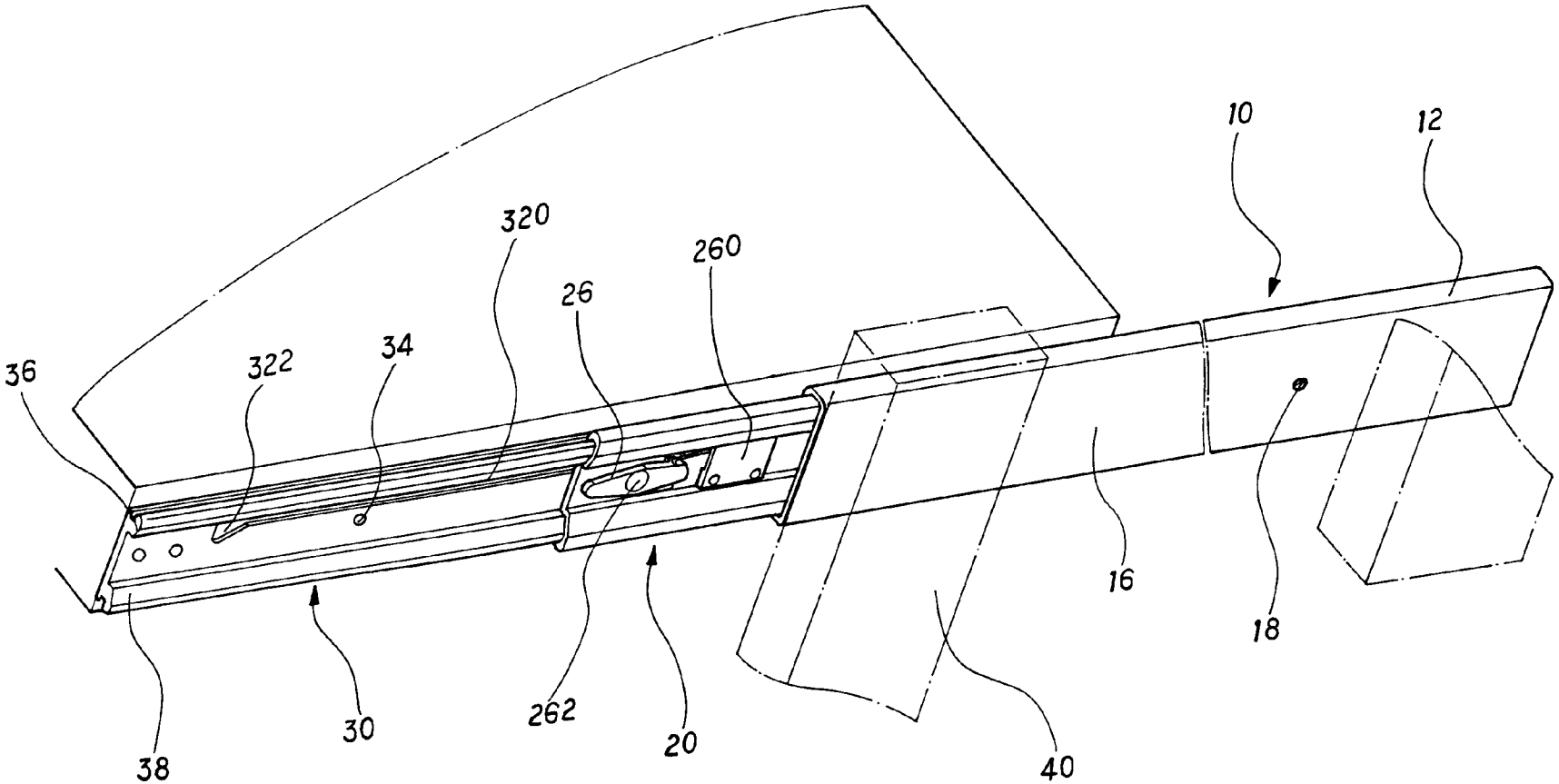
FIG. 4 is a prospective view showing the multiple steps rail of the present invention being installed to a frame.

With reference of FIG. 1, the present invention includes a retainer 10 which each longitudinal side thereof is bent as a rectangular slot 12 and 14 respectively, and the retainer 10 is formed as an approximately concave body with a width d between the two slots. On a flat 16 of the retainer 10, a plurality of through holes 18 are formed so that the retainer 10 can be fixed on a frame 40 by a plurality of locking units as shown in FIG. 4. There are stopping blocks 160, 162 formed on the concave side of the retainer 10 on the flat 16. The stopping blocks 160 and 162 are formed in opposite directions so as to constrain the sliding range in different directions (which is left and right shown in the Fig.) of a first sliding unit 20. The first sliding unit 20 is arranged in the space between the slots 12 and 14 of the retainer 10, and each longitudinal side thereOf is bent as a groove 22 and 24 respectively so that the first sliding unit 20 is formed approximately as a bow body. A mechanical switch 26 and a bidirectional stopping unit 28 are formed to the first sliding unit 20 on the two ends facing the flat 16 of the retainer 10. The mechanical switch 26 is capable of moving a latch 260 so as to buckle or release a second sliding unit 30. The bidirectional stopping unit 28 is formed on an end of the first sliding unit 20 opposite to the mechanical switch 26 and is capable of engaging the plurality of stopping blocks 160 and 162 of the retainer 10 so as to restrain the first sliding unit 20 from moving further forward or backward. The approximately bow body of the first sliding unit 20 can be sliding installed into the retainer 10, and also can receive the second sliding unit 30 for sliding within the first sliding unit 20. The second sliding unit 30 has a flat 32 and can be fixed to a case body by a plurality of through holes 34 formed on the flat 32. Each longitudinal side of the flat 32 is formed as a guiding column 36 and 38 respectively to fit and slide into the grooves 22 and 24 so that the second sliding unit 30 is slidably installed to the first sliding unit 20. The flat 32 further has a guiding groove 320 with two positioning recesses 322 and 324 facing the first sliding unit 20. The guiding groove 320 is arranged for the latch 260 so that the latch 260 can perform a positioning function for the recesses 322 and 324 at different position.

Figure 3:
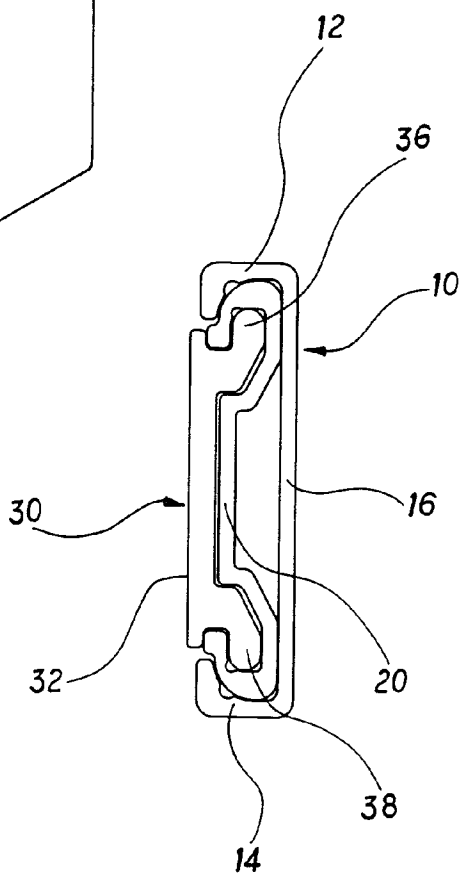
FIG. 3 is a lateral view of FIG. 2.
Figure 2:
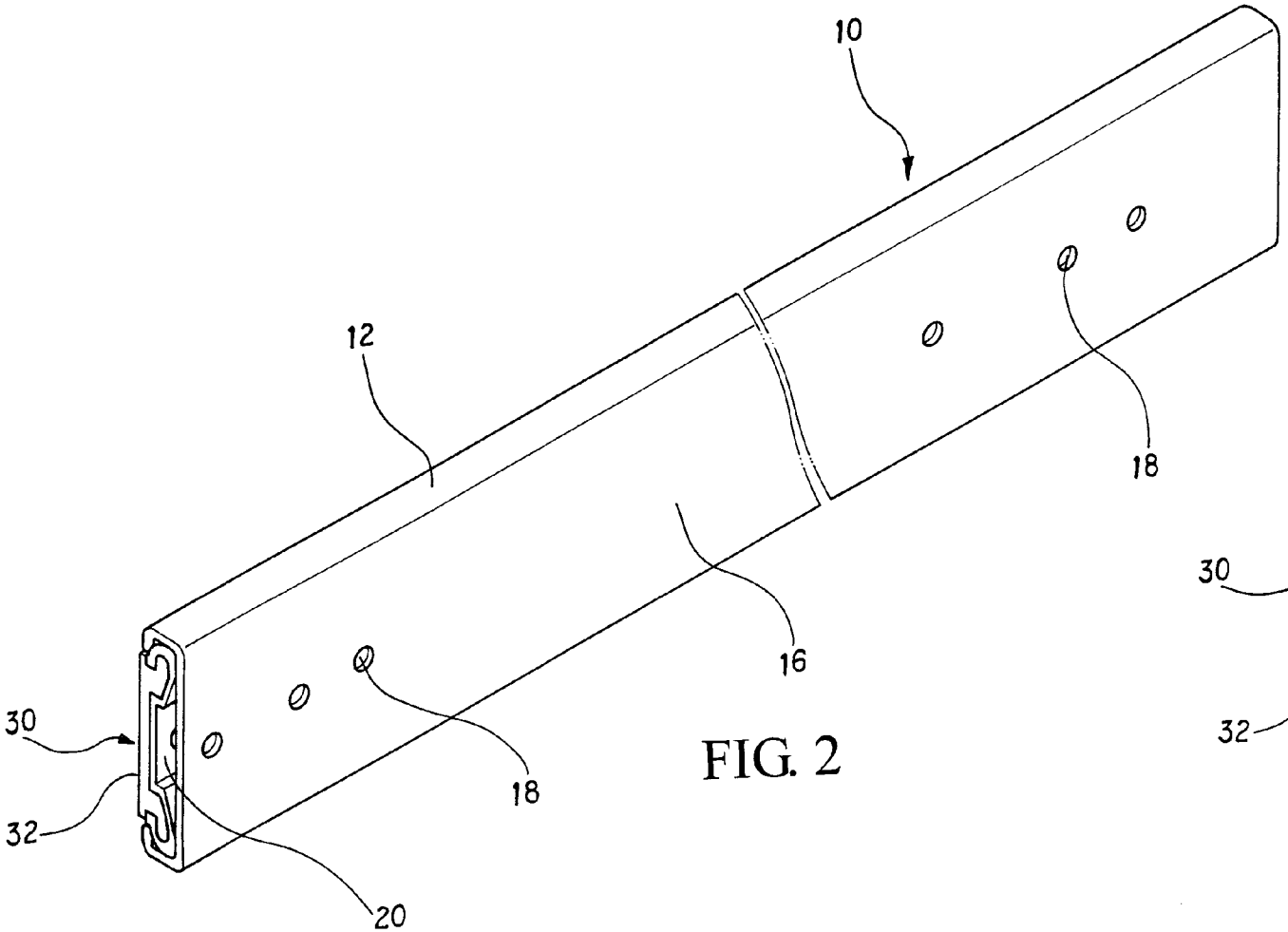
FIG. 2 is a schematic view showing the assembly of the multiple steps rail of the present invention.

Referring to FIGS. 2 and 3, it is known that the structure of the present invention from outer side to inner side consists of the retainer 10, the first sliding unit 20, and the second sliding unit 30. Through drawing out the case body fixed to the second sliding unit 30, the second sliding unit 30 will slide out from the first sliding unit 20 and the first sliding unit 20 will slide out from the retainer 10 in order.

Figure 5A:
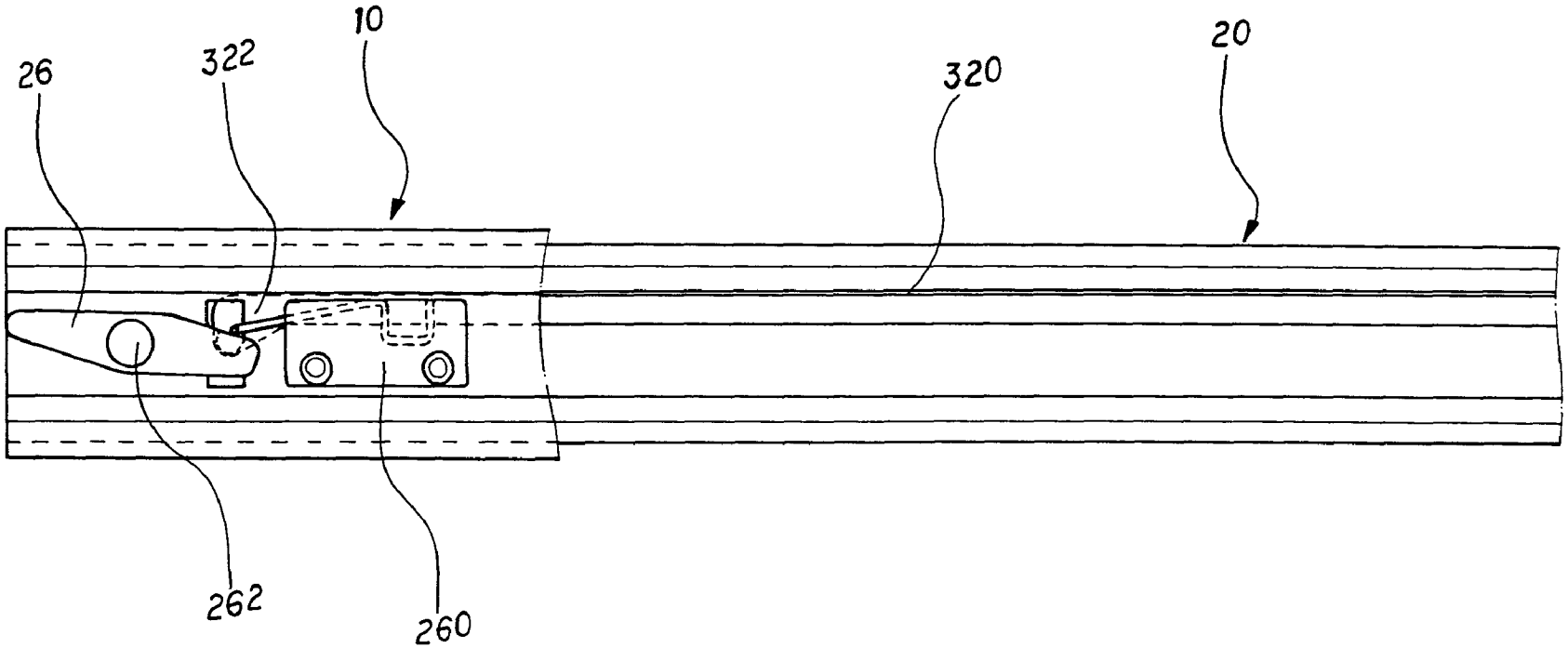
FIGS. 5A and 5B are prospective views showing the operations of a dip switch and an extending buckle while the multiple steps rail of the present invention is sliding outward.
Figure 5B:
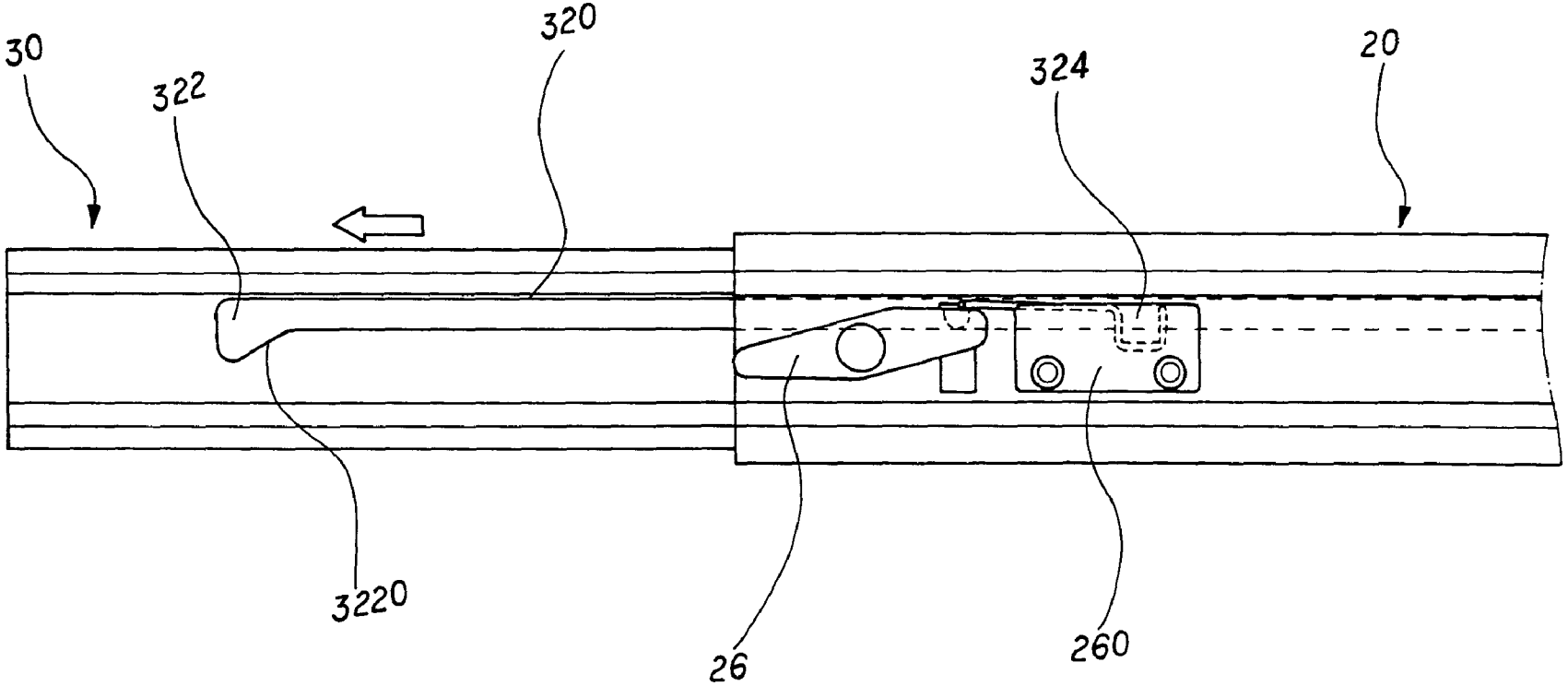

The action of the mechanical switch 26 and the latch 260 during operation of the present invention is illustrated in FIGS. 5A and 5B. The mechanical switch 26 is pivoted on the first sliding unit 20 with a pivot 262 so that the mechanical switch 26 is capable of moving up and down to move the latch 260. As shown in FIG. 5A, in a normal state the latch 260 is penetrated through the first sliding unit 20 into the positioning recess 322 of the second sliding unit 30. While the case body fixed to the second sliding unit 30 is drawing out, the second sliding unit 30 will slide out from the first sliding unit 20 so that the latch 260 will slide into the guiding groove 320 through an incline 3220 until being stopped by another positioning recess 324 as shown in FIG. 5B.

Figure 6A:
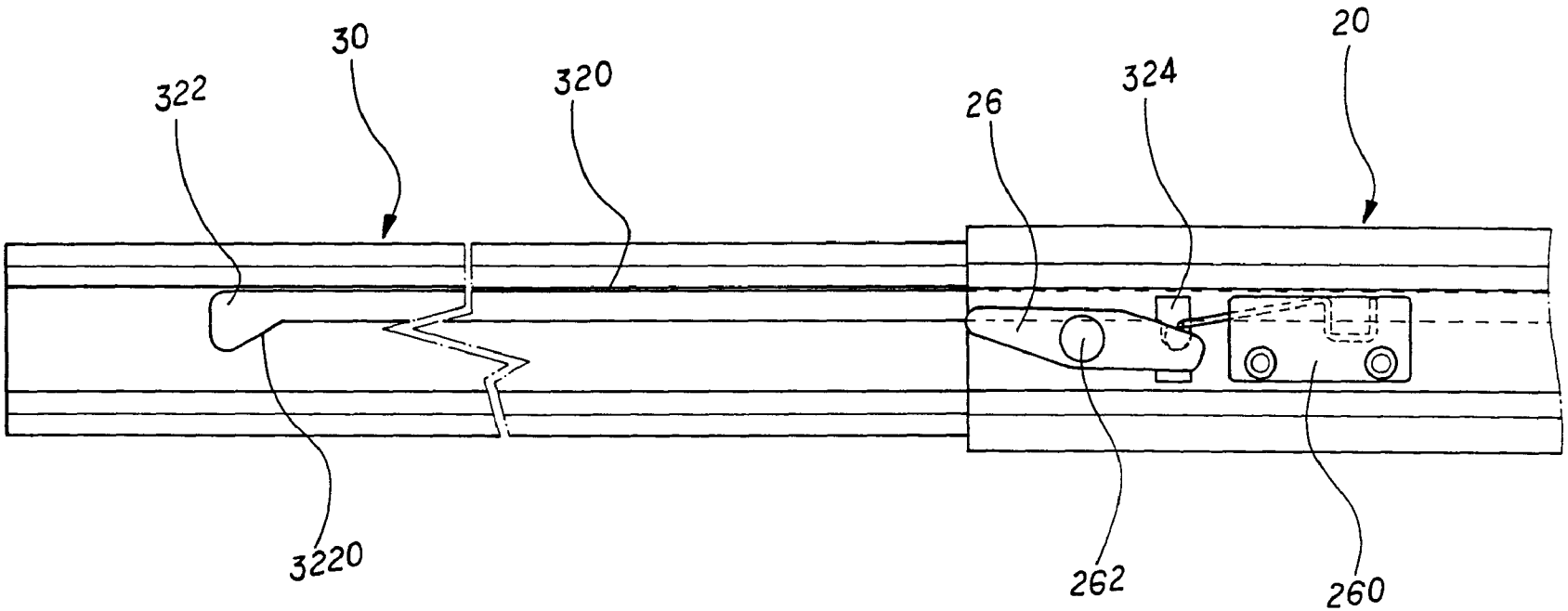
FIGS. 6A and 6B are prospective views showing the operations of the dip switch and the extending buckle while the multiple steps rail of the present invention is sliding inward.
Figure 6B:
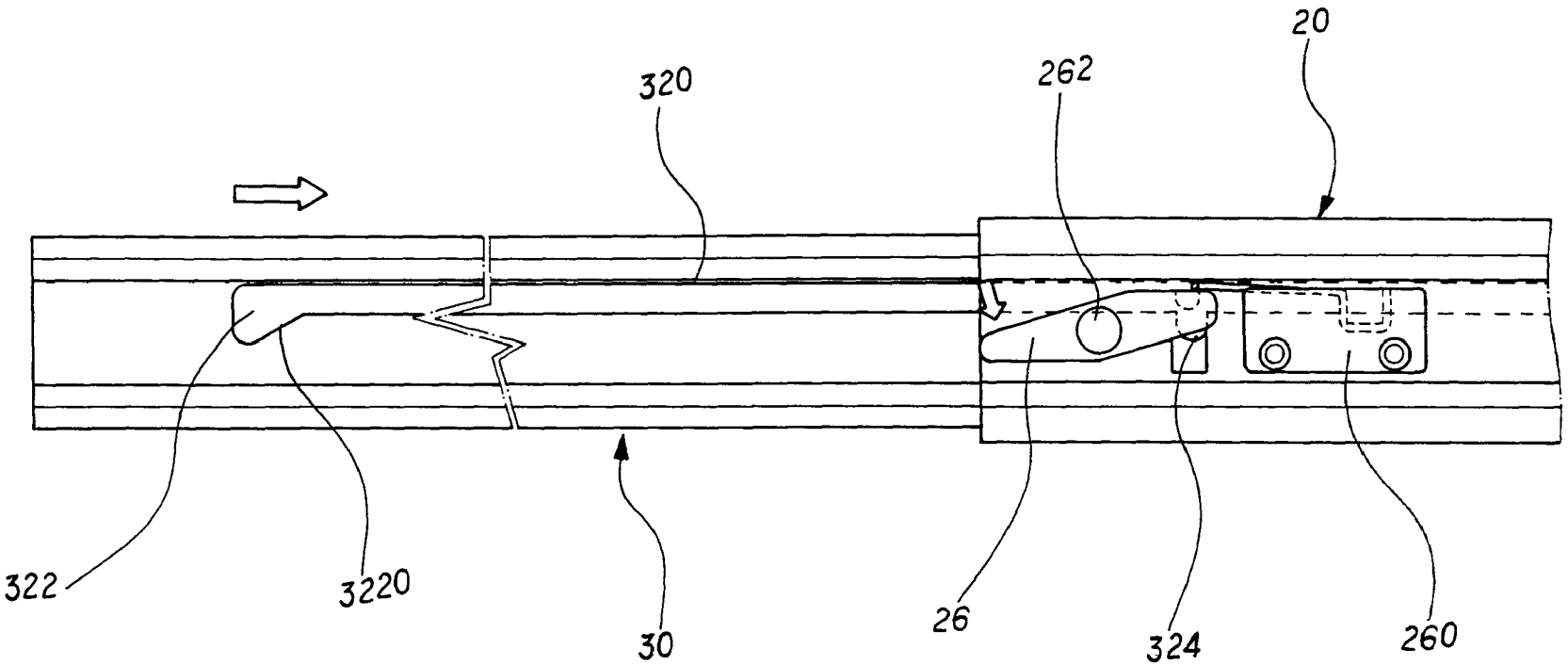

While the case body fixed to the second sliding unit 30 is pushed to be received, as shown in FIG. 6A, the latch 260 will leave the positioning recess 324 through pressing the mechanical switch 26 so that the second sliding unit 30 can be pushed to slide inward. The latch 260 will slide through the guiding groove 320 until being stopped by the positioning recess 322 as shown in FIG. 6B.

Figure 7A:
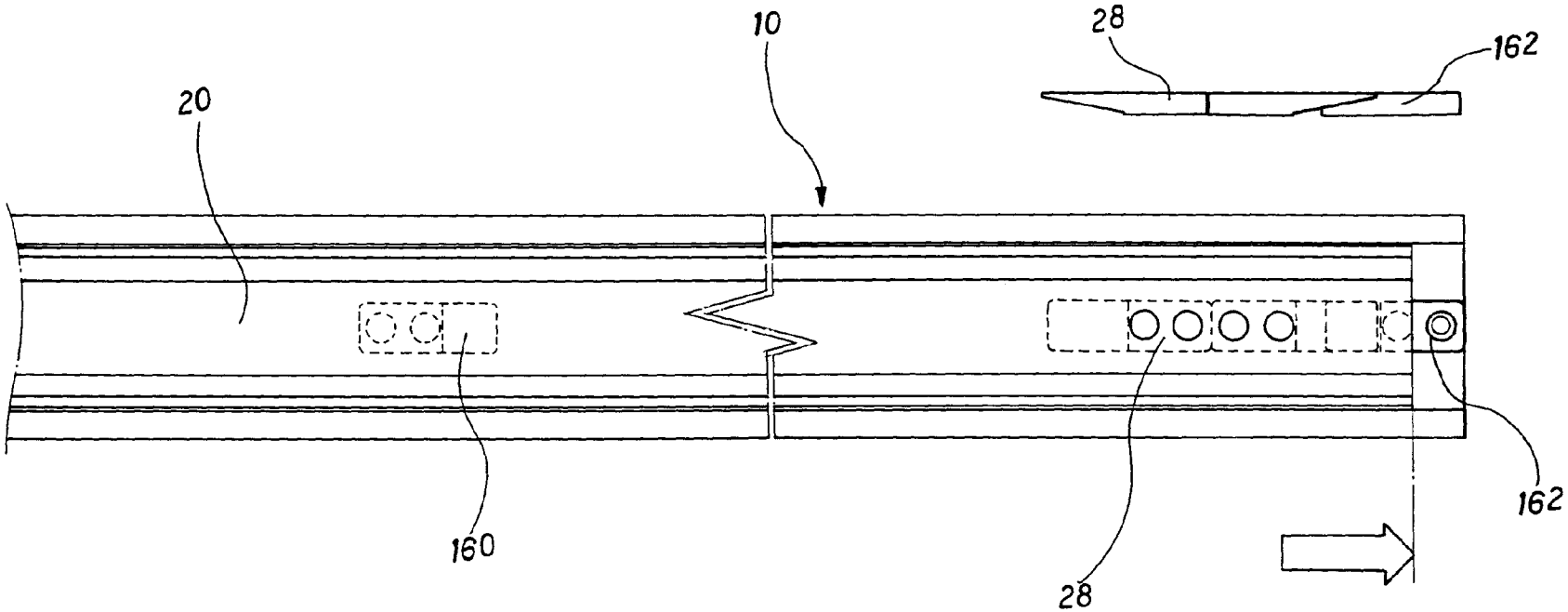
FIGS. 7A and 7B are prospective views showing the operation of the stopping units of the multiple steps rail of the present invention.
Figure 7B:
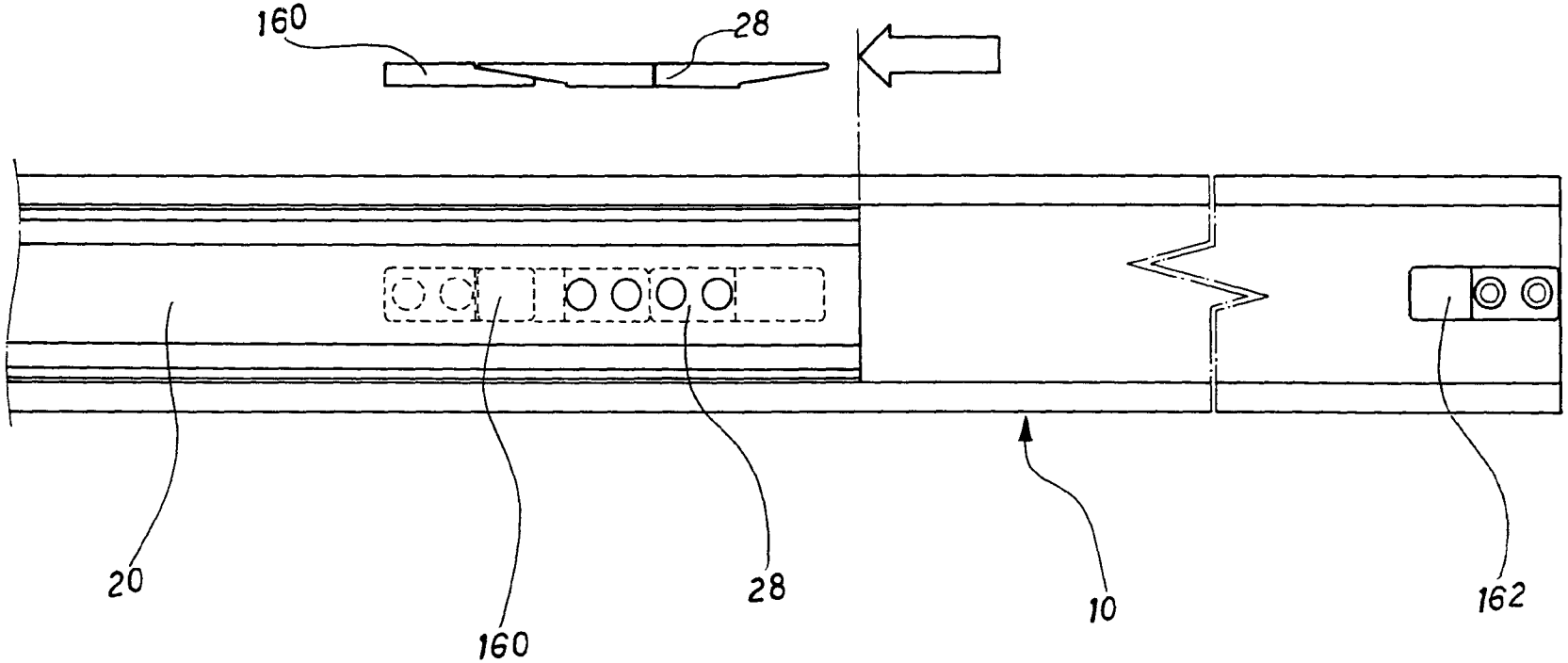

During the sliding movement illustrated in FIGS. 5A, 5B and 6A, 6B, the first sliding unit 20 also slides along the retainer 10 in the same direction with the second sliding unit 30. The bidirectional stopping unit 28 of the first sliding unit 20 will restrain the sliding range by the stopping blocks 160 and 162 formed in different directions on the retainer 10. Referring to FIG. 7A, the stopping block 162 on a rear end of the retainer 10 will act while the first sliding unit 20 is pushed to be received. Through the opposite inclines of the bidirectional stopping unit 28 and the stopping block 162, the first sliding unit 20 is prevented from sliding out of range. The opposite inclines design will smoothly and gradually stop the sliding movement and it is also power-saving, the effect can be achieved by other designs such as a stopping block with an irregular or regular surface.

Figure 8:
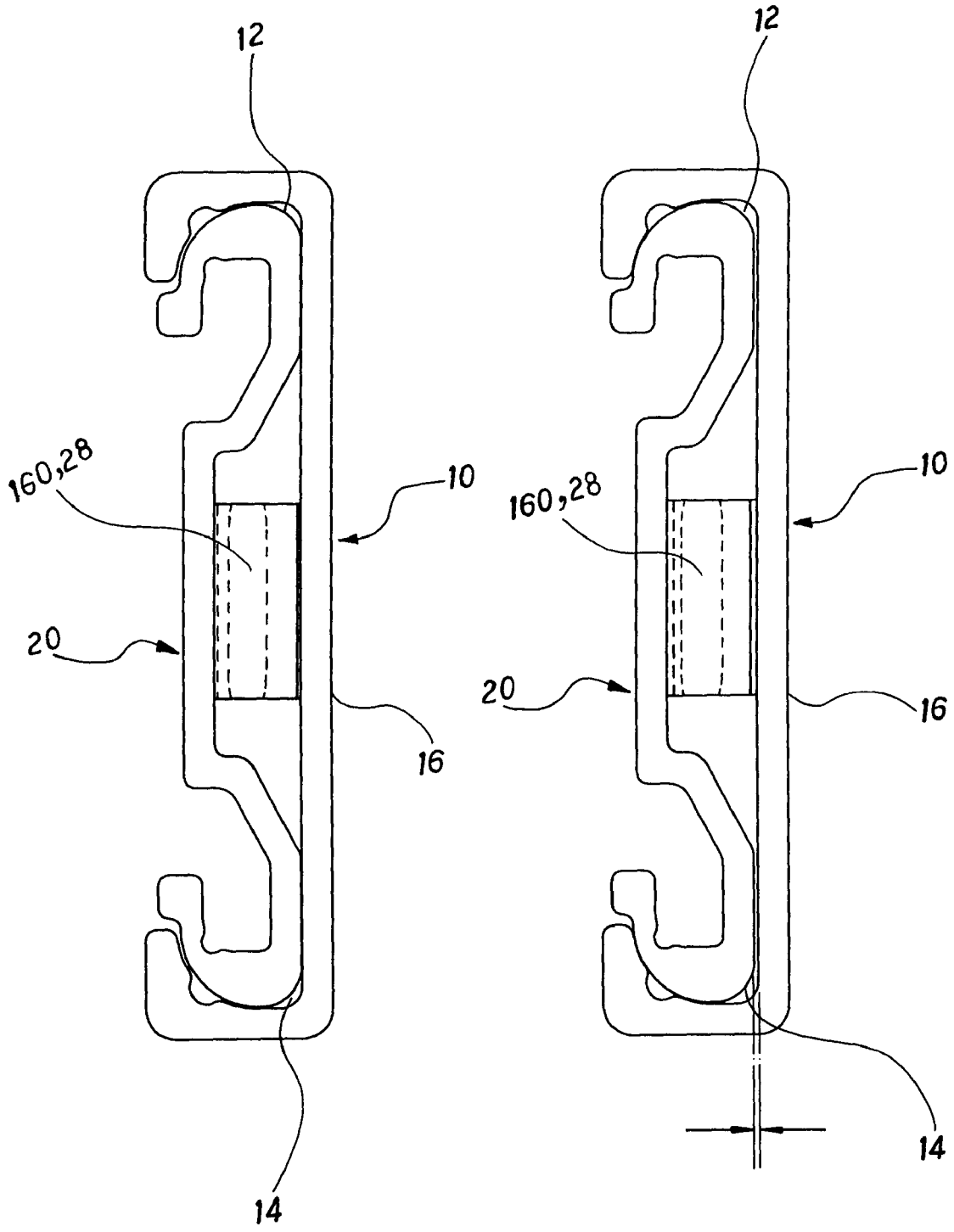
FIG. 8 is an enlarged lateral view viewing showing the assembly of a retainer and a first sliding unit of the multiple steps rail of the present invention.

As shown in FIG. 8, when the first sliding unit 20 is arranged into the retainer 10, a predetermined gap S between the two units is designed for smoothing the sliding motion so that the first sliding unit 20 can slide between the slots 12 and 14 of the retainer 10. The first sliding unit 20 can slide along the retainer 10 and being stopped and positioned by the bidirectional stopping unit 28 of the first sliding unit 20 engaging the stopping block 160 (or 162) of the retainer 10. By the opposite inclines of the bidirectional stopping unit 28 and the stopping blocks 160 and 162 engaging to each other, the first sliding unit 20 can be positioned to the retainer 10. To release the engaging, it only needs to move the first sliding unit 20 backward and it will become slidable again. Thus, the structure is very simple, convenient, and reliable.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A three-sectional sliding rail structure comprising:

a retainer, being a of a C-shape with two slots, and having two stopping blocks longitudinally arranged between the slots;

a first sliding unit, being slidably engaged within the slots of the retainer, being capable of sliding out to protrude from the retainer, and having two parallel grooves, wherein a mechanical switch linking a latch and a bidirectional stopping unit are separately fixed at two ends of the first sliding unit, both the mechanical switch with the latch and the bidirectional stopping unit are on the same side facing the retainer, and the bidirectional stopping unit will be stopped by either of the stopping blocks when the first sliding unit is slid out or in the retainer; and a second sliding unit, being slidably engaged within the grooves of the first sliding unit, being capable of sliding out to protrude from the first sliding unit, and having a positioning groove with two positioning recesses facing the first sliding unit, wherein the mechanical switch will be triggered by either of the positioning recesses to make the positioning recess unidirectionally locked by the latch when the second sliding unit is slid out or in the first sliding unit.

2. The three-sectional sliding rail structure as claimed in claim 1, wherein the mechanical switch is pivoted on the first sliding unit with a pivot so that the mechanical switch is capable of moving up and down to move the latch.

3. The three-sectional sliding rail structure as claimed in claim 1, wherein at least one of the positioning recesses has an inclined edge corresponding to the latch for unidirectionally locking the latch.

4. The three-sectional sliding rail structure as claimed in claim 1, wherein each of the stopping blocks of the retainer has an incline, which are in different directions.

5. The three-sectional sliding rail structure as claimed in claim 4, wherein the bidirectional stopping unit has two inclines separately corresponding to the inclines of the stopping blocks.

* * * * *